United States Patent [19]

Vedova et al.

[11] 4,054,442

[45] Oct. 18, 1977

[54] METHOD FOR RECOVERING SCHEELITE FROM TUNGSTEN ORES BY FLOTATION

[75] Inventors: Ronald Vedova, Englehart, Canada; Norman LeRoy Grauerholz, Lewiston, N.Y.

[73] Assignee: Union Carbide Corporation, New York, N.Y.

[21] Appl. No.: 659,999

[22] Filed: Feb. 23, 1976

[51] Int. Cl.[2] ..... B03D 3/06; C22B 3/00

[52] U.S. Cl. ..... 75/2; 209/166; 423/55

[58] Field of Search ..... 75/1, 2, 108; 209/166, 209/167; 423/165, 53, 55

[56] References Cited

U.S. PATENT DOCUMENTS

| | | | |
|---|---|---|---|
| 1,953,431 | 4/1934 | Patek | 209/166 |
| 3,337,048 | 8/1967 | Mercade | 209/166 |
| 3,915,391 | 10/1975 | Mercade | 209/166 |

*Primary Examiner*—L. Dewayne Rutledge
*Assistant Examiner*—Michael L. Lewis
*Attorney, Agent, or Firm*—Frederick J. McCarthy, Jr.

[57] ABSTRACT

A flotation process for recovering scheelite from low-grade tungsten ores containing calcium-bearing minerals other than scheelite. Calcium oxide (lime) is added to an ore pulp together with a carbonate alkalizing agent, dispersant and anionic collector. The pulp is subsequently subjected to flotation and the scheelite recovered.

5 Claims, No Drawings

METHOD FOR RECOVERING SCHEELITE FROM TUNGSTEN ORES BY FLOTATION

The present invention is directed to the processing of tungsten ores. More particularly, the present invention is directed to the recovery of scheelite from low-grade tungsten ores, e.g., contaning from about 0.1 to 10% $WO_3$, by the selective flotation of scheelite.

Tungsten ores containing scheelite (calcium tungstate) have previously been subjected to flotation precedures in order to recover scheelite. However, the flotation of scheelite concentrate was accompanied by the other calcium-bearing minerals in the ore, such as calcite, apatite and flourite which tend to float with the scheelite. Consequently, unless special and relatively costly measures were taken, the scheelite concentrate obtained was undesirably contaminated and of limited commercial importance.

It is therefore an object of the present invention to provide an economical and straight-forward process for the selective flotation of scheelite from tungsten ores containing other calcium-bearing minerals such as calcite, apatite and flourite.

Other objects will be apparent from the following description and claims.

A process in accordance with the present invention comprises forming a pulp of tungsten ore, and adding calcium oxide, a carbonate alkalizing compound, and dispersant to the pulp followed by the addition of an anionic collector to the dispersed pulp and thereafter subjecting the pulp to flotation to selectively recover the scheelite as a concentrate.

In the practice of the present invention, the calcium oxide addition is preferably added to the ore pulp prior to the addition of alkalizing agent and dispersant as shown in the examples. However, the above materials can be added in any order provided that, upon addition of calcium oxide, and conditioning as hereinafter described, the pH of the aqueous media of the pulp is increased by at least about 0.1 pH unit.

In the practice of a preferred embodiment the present invention, the tungsten ore is finely divided, e.g., to 65 mesh (Tyler series) and finer, preferably finer than 200 mesh. The finely divided ore is pulped, the aqueous ore pulp preferably having a solids content of 20 to 40% by weight. If sulfides are present in the ore they are removed from the pulp by flotation by conventional techniques well known to the art using sulfide collectors. Lime, e.g., calcium oxide or hydrated calcium oxide, is added to the pulp conveniently in the form of a solution, an aqueous slurry, or as dry solids, the particles suitably being 28 mesh and finer, and preferably about 100 mesh and finer. The amount of the lime addition is at least sufficient to raise the pH of the aqueous media of the pulp at least 0.1 pH unit and is in the range of about 0.1 to 4 pounds per ton with lesser amounts in this range being used with pulps having higher solids contents. The pulp is thereafter subjected to agitation sufficient to suspend substantially all of the solids in the pulp in the aqueous media and such agitation is continued for at least about 5 minutes to condition the pulp. Following the lime addition and conditioning, a carbonate alkalizing agent is added to the pulp, preferably sodium carbonate, although other carbonates such as alkali metal carbonates may be used. The amount of carbonate addition, upon conditioning for at least about 5 minutes, to provide reaction with calcium ion in the pulp, forms a precipitation of calcium and is in the range of about 0.25% to 12 pounds per ton or ore. The occurrence of a precipitate can be detected in this embodiment by a decrease in the calcium ion content of the pulp. Conditioning of the carbonate containing pulp is accomplished by subjecting the pulp to agitation sufficient to suspend substantially all of the solids in the pulp in the aqueous media. Following the carbonate addition and conditioning, a dispersant is added, preferably sodium silicate. The amount of this addition is from about 0.1 to 10 pounds of sodium silicate per ton or ore and the pulp is further conditioned, as described above, for at least about 5 minutes. The pH of the pulp at this stage is from about 9 to 12, preferably about 9.5 to 10.5 and the specific amounts of lime, carbonate and dispersant are predetermined to establish the desired pH. Following the dispersant addition and conditioning, an anionic collector is added to the pulp. It has been found that oleic acid alone can be used as the collector but that naphthenic acid alone is not suitable. Preferably a mixture of naphthenic and oleic acid in weight ratio of about 1:1 (e.g., 40–60% of each acid) is used to obtain a substantial improvement in scheelite recovery. The pulp is now subjected to flotation by conventional techniques and the scheelite concentrate is floated and recovered. The concentrate recovered can be expected to contain about 90% by weight or more of the scheelite from the starting ore material. The grade of the rougher concentrate will usually vary, depending on the starting ore analysis, from about 1 to 60% $WO_3$. The rougher concentrate should contain from about 5 to 50 times the initial concentration of tungsten in the ore. After cleaning by reflotation without additional reagent, or using minor amounts of conventional reagents, the concentrate of tungsten if further substantially increased.

The optimum amounts of the aforementioned additions will depend on the actual ore composition. The following examples provide information as to optimum additions and conditioning periods for various scheelite-containing ores.

EXAMPLE I

A low-grade, tactite tungsten ore from Boca de Lage, Brazil having an assay of 1.20% $WO_3$ and containing garnet, fluroite, calcite and diopside was ground to pass through 100 mesh (Tyler series). The finely divided ore, in the amount of 1000 grams, was slurried with water to provide a solids (ore) content of 30% by weight. The slurry was introduced into a Denver D-1 laboratory flotation cell and agitated in the flotation cell by rotation of the impeller at 1200 rpm. Lime (CaO), sized 28 mesh and finer, in the amount of 0.5 gram (1 lb. per ton), was subsequently added to the slurry which was agitated for ten minutes in the flotation cell after which two grams of sodium carbonate (4 lb. per ton) were added to the slurry and agitated for 10 minutes. This lime addition raised the pH of the aqueous media of the slurry from 8 to 8.9 and the sodium carbonate addition raised the pH from 8.9 to 9.2. Subsequently 3.6 grams of sodium silicate (grade 47) (7.2 lb. per ton) were added to the slurry, which raised the pH of the slurry to 10.25. The slurry was agitated for ten minutes, to disperse the gangue minerals. A mixture of naphthenic acid and oleic acid (1:1 by weight) was added to the slurry in the amount of 0.5 grams (1.0 lb. per ton) and the slurry was agitated for 5 minutes. The scheelite concentrate was floated, using additional fatty acid (0.25gram) and recovered and, after cleaning by flotation without any reagent addition, contained 56.7% $WO_3$ by weight. The overall recovery of $WO_3$ from the starting ore was 86.13%.

EXAMPLE II

A low-grade tactite tungsten ore from Tempiute, Nevada having an assay of 0.57% $WO_3$ and containing silica, silicates, calcite, fluorite, pyrrhotite, pyrite, and sphalerite was ground to pass through 100 mesh (Tyler series). The finely divided ore, in the amount of 1,000 grams, was slurried with water to provide a solids (ore) content of 30% by weight. The slurry was introduced into a Sala wet magnetic separator to remove magnetic sulfides and subsequently introduced into a Denver D-1 laboratory flotation cell. The slurry was agitated in the flotation cell by rotation of the impeller at 1200 rpm. An addition of potassium ethyl xanthate in the amount of 0.025 gram (0.05 lb. per ton) was made to the agitated slurry in the flotation cell to selectively float pyrite using pine oil as the frothing agent.

After 5 minutes the pyrite was floated and removed. Subsequently an addition of lime (calcium oxide) (sized 28 mesh and finer) in the amount of 0.5 gram (1 lb. per ton) was made to the slurry in the flotation cell and the slurry was agitated for ten minutes; this addition of lime raised the pH of the slurry and depressed any remaining pyrites. Copper sulfate, in the amount of 0.15 gram (0.3 per ton) was added as an aqueous solution to the slurry which was agitated for five minutes; the purpose of this addition was to activate the zinc sulfide in the slurry. Potassium amyl xanthate, in the amount of 0.01 gram was added to the slurry which was agitated and after the addition of pine oil, zinc sulfide was floated and removed. Lime (CaO), in the amount of 0.5 gram (1 lb. per ton), sized 28 mesh and finer, was subsequently added to the slurry which was agitated for ten minutes in the flotation cell after which 2 grams of sodium carbonate (4 lb. per ton) were added to the slurry and agitated for ten minutes. This further lime addition, together with the previous lime addition, raised the pH of the aqueous media of the slurry by at least 0.1 pH unit. Subsequently 4.0 grams of sodium silicate (grade 47) (8 lb. per ton) were added to the slurry, which raised the pH of the slurry to 10.6. The slurry was agitated for 10 minutes, to disperse the gangue minerals. A mixture of naphthenic acid and oleic acid (1:1 by weight) was added to the slurry in the amount of 0.25 gram (0.5 lb. per ton). The scheelite concentrate was floated and recovered and, after cleaning by flotation without any reagent addition, contained 26.1% $WO_3$ by weight. The overall recovery of $WO_3$ from the starting ore was 85.5%.

EXAMPLE III

A low-grade tactite tungsten ore from Tempiute, Nevada having an assay of 0.52% $WO_3$ and containing silica, silicates, calcite, fluorite, pyrrhotite, pyrite and sphalerite was ground to pass through 100 mesh (Tyler series). The finely divided ore, in the amount of 1,000 grams in mixture with 0.12 gram calcium oxide (0.25 lb. per ton) was slurried with water to provide a solids content of 30% by weight. The slurry was introduced into a Sala wet magnetic separator to remove magnetic sulfides and subsequently introduced into a Denver D-1 laboratory flotation cell. The slurry was agitated in the flotation cell by rotation of the impeller at 1,200 rpm. An addition of xanthate in the amount of 0.015 gram (0.03 lb. per ton) and 0.065 gram of copper sulfate (0.13 lb. per ton) was made to the agitated slurry in the flotation cell to selectively float sulfides using Union Carbide R-23 as the frothing agent.

After six minutes the sulfides were floated and removed. Lime (CaO), in the amount of 0.25 gram (0.5 lb. per ton), sized 28 mesh and finer, was subsequently added to the slurry which was agitated for 5 minutes in the flotation cell after which one gram of sodium silicate (2 lb. per ton) was added to the slurry and agitated for 5 minutes. Subsequently one gram of sodium carbonate (2 lb. per ton) was added to the slurry and agitated for 5 minutes. An additional one gram (2 lb. per ton) of sodium silicate was added and the slurry was agitated for 5 minutes to disperse the gangue minerals. A mixture of naphthenic acid and oleic acid (1:1 by weight) was added to the slurry in the amount of 0.15 gram (0.3 lb. per ton). The scheelite concentrate was floated using additional fatty acid (0.15 gram) and recovered and, after cleaning by 2 stages of flotation using 1 gram (2 lb. per ton) of sodium silicate, contained 17.77% $WO_3$ by weight. The overall recovery of $WO_3$ from the starting ore was 86.44%.

What is claimed is:

1. In a flotation process for recovering scheelite by the flotation thereof from an aqueous pulp of low-grade tungsten ore containing calcium bearing minerals in addition to scheelite said process involving the addition to the aqueous ore pulp of a carbonate alkalizing agent and a dispersant followed by an anionic collector, the improvement which comprises adding to the ore pulp, prior to the addition of the anionic collector and the dispersant, if added as a silicate dispersant, an amount of calcium oxide sufficient to raise the pH of the aqueous media of the pulp by 0.1 pH unit and form a precipitate of calcium upon conditioning the pulp by agitation sufficient to suspend substantially all of the solids in the pulp in the aqueous pulp media, said conditioning being for at least about five minutes and the pH of the ore pulp, prior to the addition of anionic collector being in the range of about 9–12.

2. A method in accordance with claim 1 wherein the calcium oxide addition is from about 0.1 to 4 pounds per ton.

3. A method in accordance with claim 1 wherein the pH of the ore pulp prior to the addition of the anionic collector is from about 9.5 to 10.5.

4. A method in accordance with claim 1 wherein the anionic collector is naphthenic acid and oleic acid in a weight ratio about about 1:1.

5. A method in accordance with claim 1 wherein the calcium oxide addition is in a form selected from the group consisting of solutions, aqueous slurries and finely divided solids.

* * * * *